United States Patent [19]

Kato et al.

[11] Patent Number: 5,039,080

[45] Date of Patent: Aug. 13, 1991

[54] RECORDING SHEET FEEDING APPARATUS

[75] Inventors: Shogo Kato; Tsutomu Suka, both of Hachioji, Japan

[73] Assignee: Konica Corporation, Tokyo, Japan

[21] Appl. No.: 400,077

[22] Filed: Aug. 29, 1989

[30] Foreign Application Priority Data

Sep. 1, 1988 [JP] Japan ..... 63-219894

[51] Int. Cl.[5] ..... B65H 3/52

[52] U.S. Cl. ..... 271/122; 271/125

[58] Field of Search ..... 271/121, 122, 125

[56] References Cited

U.S. PATENT DOCUMENTS

| | | | |
|---|---|---|---|
| 4,556,209 | 12/1985 | Tsubo | 271/122 X |
| 4,638,987 | 1/1987 | Sakurai | 271/122 X |
| 4,705,265 | 11/1987 | Hirota | 271/122 |
| 4,801,134 | 1/1989 | Yokoyama | 271/122 |

*Primary Examiner*—Richard A. Schacher

*Attorney, Agent, or Firm*—Jordan B. Bierman

[57] ABSTRACT

Disclosed is a recording sheet feeding apparatus for feeding recording sheets singly to a copying machine, comprising a sheet storage cassette for storing the recording sheets, a conveyance roller for conveying the recording sheets from the sheet storage cassette to a feeding roller, the feeding roller for feeding the recording sheets conveyed from the sheet storage cassette to the copying machine, a sheet separation roller, in contact with the feeding roller, for separating one of the recording sheets from other recording sheets so that the recording sheets are fed to the copying machine singly, and a rotation resister for resisting the rotation of the sheet separation roller by frictional resistance of a resistant member in which the sheet separation roller is further capable of rotating in an opposing direction to the feeding roller by the resiliency of a spring so that the other recording sheets separated by the sheet separation roller are fed back towards the sheet storage cassette.

4 Claims, 6 Drawing Sheets

RECORDING SHEET FEEDING APPARATUS

BACKGROUND OF THE INVENTION

This invention relates to a paper feeding apparatus for feeding recording sheets in use with a copy machine, a facsimile, a printer, and so forth; and more particularly to a double sheet feeding preventing apparatus to prevent double feeding of recording sheets.

Conventionally, in printing apparatus such as a copy machine, a facsimile, a printer, and the like, a paper feeding apparatus, which can feed recording sheets one by one from the top or the bottom of stacked papers, such as a paper tray, a paper feeding cassette, and a paper stacker, and convey them to an image recording unit and the like, is installed.

In a document feeding unit of a copy machine or an image reading apparatus, a paper feeding unit, which can feed documents one by one from the top or the bottom of stacked documents such as a paper feeding tray, and convey them to an exposure unit on a document platen glass, is installed. Generally speaking, in this kind of paper feeding apparatus to feed recording sheets, disclosed in Japanese Patent Publication Open to Public Inspection Nos. 105834/1987 and 57447/1988, a feeding roller and a separating roller are installed which come into contact with each other ahead of a delivery roller. A sheet conveyed by the delivery roller passes through between the feeding roller and the separating roller. While the sheet passes through between the two rollers, it is separated from other sheets due to the function of the two rollers and double feeding is positively prevented.

Referring to the example shown in FIG. 6, the paper feeding apparatus mentioned above will be explained as follows. As shown in the drawing, in a case of an ordinary type of paper feeding apparatus, a delivery roller 1 is located with pressure on papers P piled up in a paper tray, and the paper P is conveyed towards the separating roller 3 by the rotation of the delivery roller 1. In this paper feeding apparatus, a paper separating mechanism consisting of the feeding roller 2 and the separating roller 3, which face each other, is located ahead of the delivery roller 1. When a plurality of papers P have been conveyed, in other words double feeding has occurred, only the top sheet passes through and the others are blocked or returned due to the function of the mechanism.

This type of mechanism is usually called 'a friction roller paper separating mechanism' and is in practical use in many paper feeding apparatuses.

In the paper separating mechanism shown in FIG. 6, the feeding roller 2 is driven through the gears Z1 and Z2 by a drive source not shown here, together with the shaft 4. The separating roller 3 is supported by the shaft 5 to which the gear 7 is fixed, and the shaft 5 is supported by a frame which is not shown in the drawing. The separating roller 3 can rotate freely because of the structure mentioned above. This frame is pressed or drawn by a spring located between the frame and the fixed portion of the copy machine frame in order to press the separating roller 3 to the feeding roller 2.

The gear Z7 is engaged with the intermediate gear Z6 which is engaged with the gear Z5 fixed to the torque limiter shaft 7 equipped with the torque limiter 6. The gear Z4 is mounted at the opposite end of the torque limiter shaft 7 and connected to the gear ZZ through the intermediate double gears Z3B and Z3A. Drive power is transmitted from the power source to the torque limiter shaft 7 by the gear train through the gears Z1 and Z2.

In the process of paper feeding by the paper feeding apparatus, first of all the upper surface of papers P is lifted up and the delivery roller 1 and the feeding roller 2 start to rotate according to a paper feeding signal. The delivery roller 1 which is pressed to the upper surface of papers with the prescribed pressure, conveys a paper P to the nip position between the feeding roller 2 and the separating roller 3. After that, the delivery roller is released from the paper surface.

The separating roller 3 is driven in the opposing direction of the feeding direction of the paper P through the above-mentioned gear train, Z2, Z3, Z4, and Z5, and the torque limiter 6. The separating roller 3 comes into contact with the feeding roller 2 with pressure by the function of the frame spring connected with the shaft of the separating roller, and the spring roller 3 rotates against the resistance created by the torque limiter 6.

When the separating roller 3 directly comes into contact with the feeding roller 2, in other words when there is no paper at the nip position or a sheet of paper P is conveyed into the nip position, the separating roller 3 follows the feeding roller 2 because the rolling friction caused between two rollers is more than enough to exceed the rotation resistance of the separating roller 3. But when more than 2 sheets are conveyed into the nip position, the rotation resistance of the separating roller is bigger than the friction between the sheets and the separating roller is reversed and pushes back the lower sheet to prevent double feeding. In FIG. 6, the continuous lines with arrow marks drawn on each rotation member show the rotation directions when sheet papers are not double fed; and the dashed lines with arrow marks show the rotation directions when the sheets are double fed.

However, in conventional paper separating mechanism, the torque limiter is rotated against the rotation resistance to the inner shaft by the power source through the gear train as explained above. Therefore, the gear train and the power transmitting shafts are necessary. Accordingly, space to locate them in the apparatus is required. As a result, the layout of other parts is restricted in design because of the above-mentioned drive unit. Furthermore, it is also an obstacle in the way of making the apparatus compact. Since this mechanism needs torque to drive the separating roller reversely to prevent double feeding of sheets, the power source is burdened with a heavy load at each time. The conventional mechanism requires a number of drive units, such as the gear train and other drive transmitting units. It results in increased cost of parts and increased labor to assemble and maintain the apparatus.

SUMMARY OF THE INVENTION

An object of the present invention is to provide a recording sheet feeding apparatus which can realize a reduction of the motor load caused by reverse rotation of a torque limiter to prevent double feeding, make the apparatus compact, and reduce the cost by eliminating the disadvantages of the conventional paper feeding apparatus.

In view of the foregoing, an object of the present invention is to provide a recording sheet feeding apparatus which is equipped with a delivery roller which comes into contact with a pile of sheets with pressure and delivers one sheet, a feeding roller located ahead of the delivery roller which rotates in the sheet conveyance direction, and a separating roller which comes into contact with the feeding roller with pressure, wherein the above-mentioned separating roller is given a constant torque by a spring through a torque limiter to rotate in the opposite direction of sheet conveyance.

Furthermore, the spring connected with the torque limiter in this apparatus is tensioned by twisting the spring as the separating roller rotates in the normal direction of sheet conveyance. When sheets are double fed between the sheet feeding roller and the separating roller, the resiliency of the spring rotates the separating roller in the reverse direction. As a result, only the first sheet is conveyed forward by the feeding roller and the second and following sheets are returned backward by the separating roller. The present invention has the above-mentioned structural features.

DETAILED DESCRIPTION OF THE INVENTION

Figure 1:
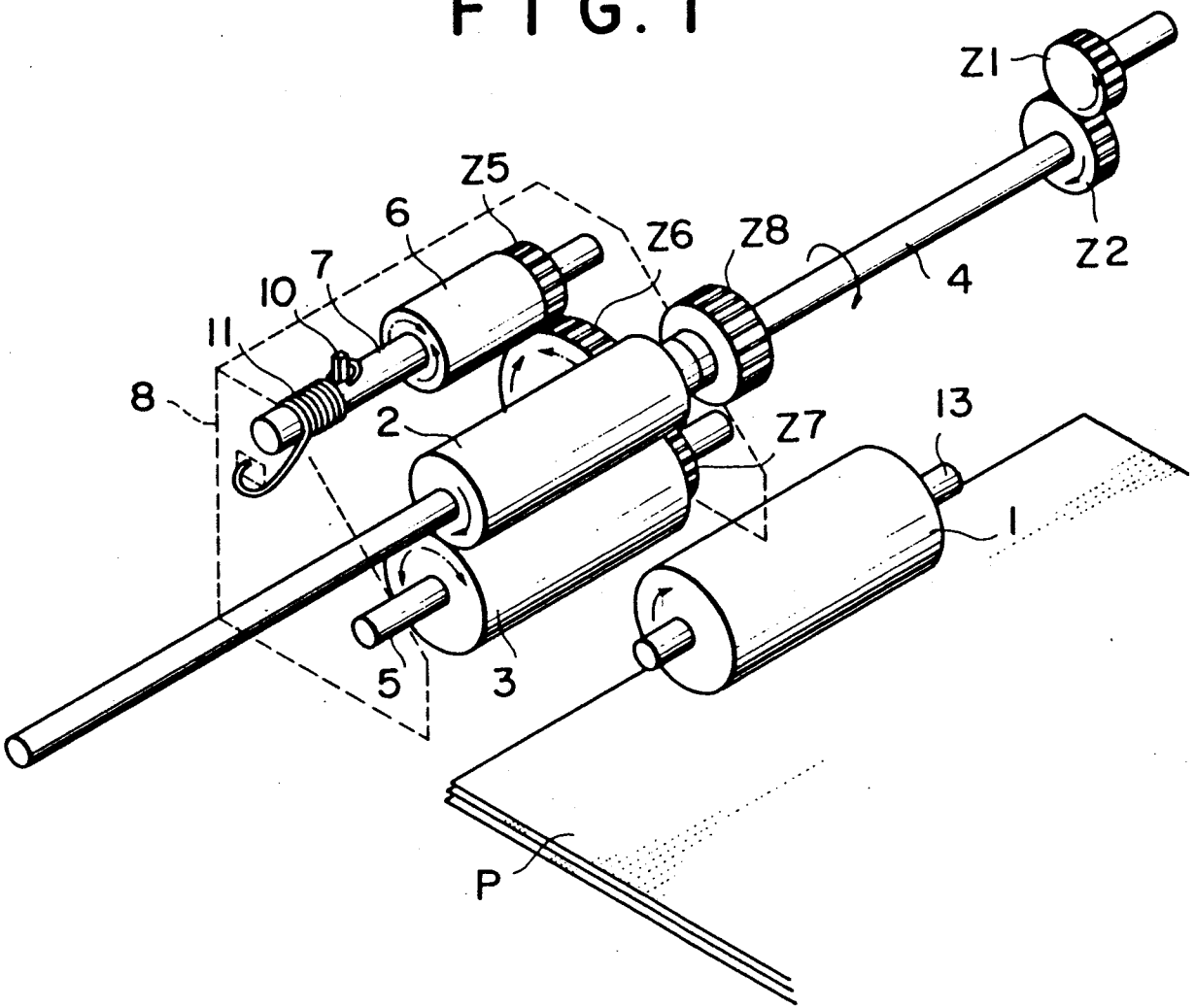
FIG. 1 is a perspective view showing the principal portion of a paper feeding apparatus of the present invention.

Referring now to the drawings, an embodiment of the present invention will be explained as follows.

Figure 2:
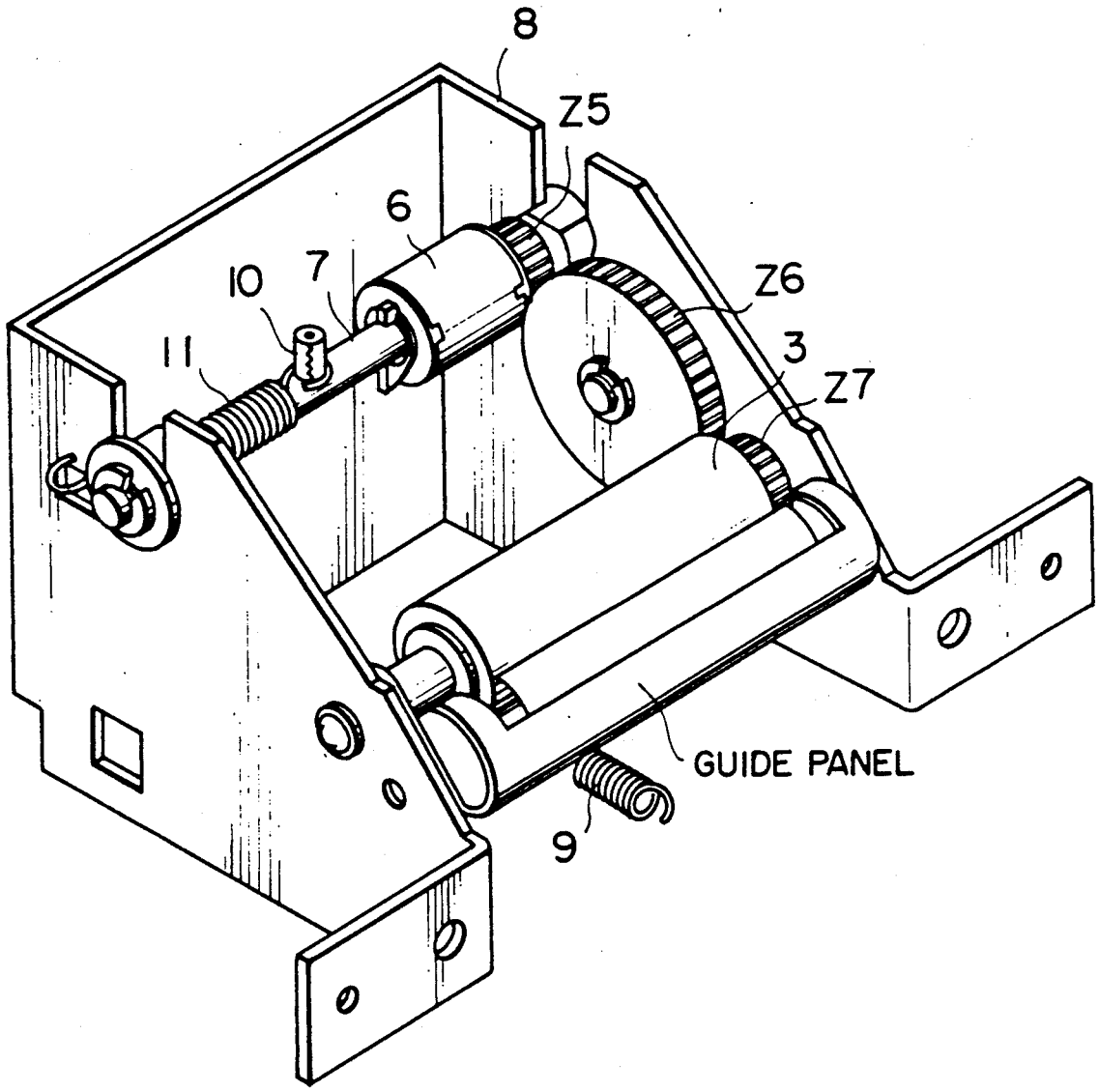
FIG. 2 is a perspective view of a roller unit of the paper feeding apparatus.
Figure 5:
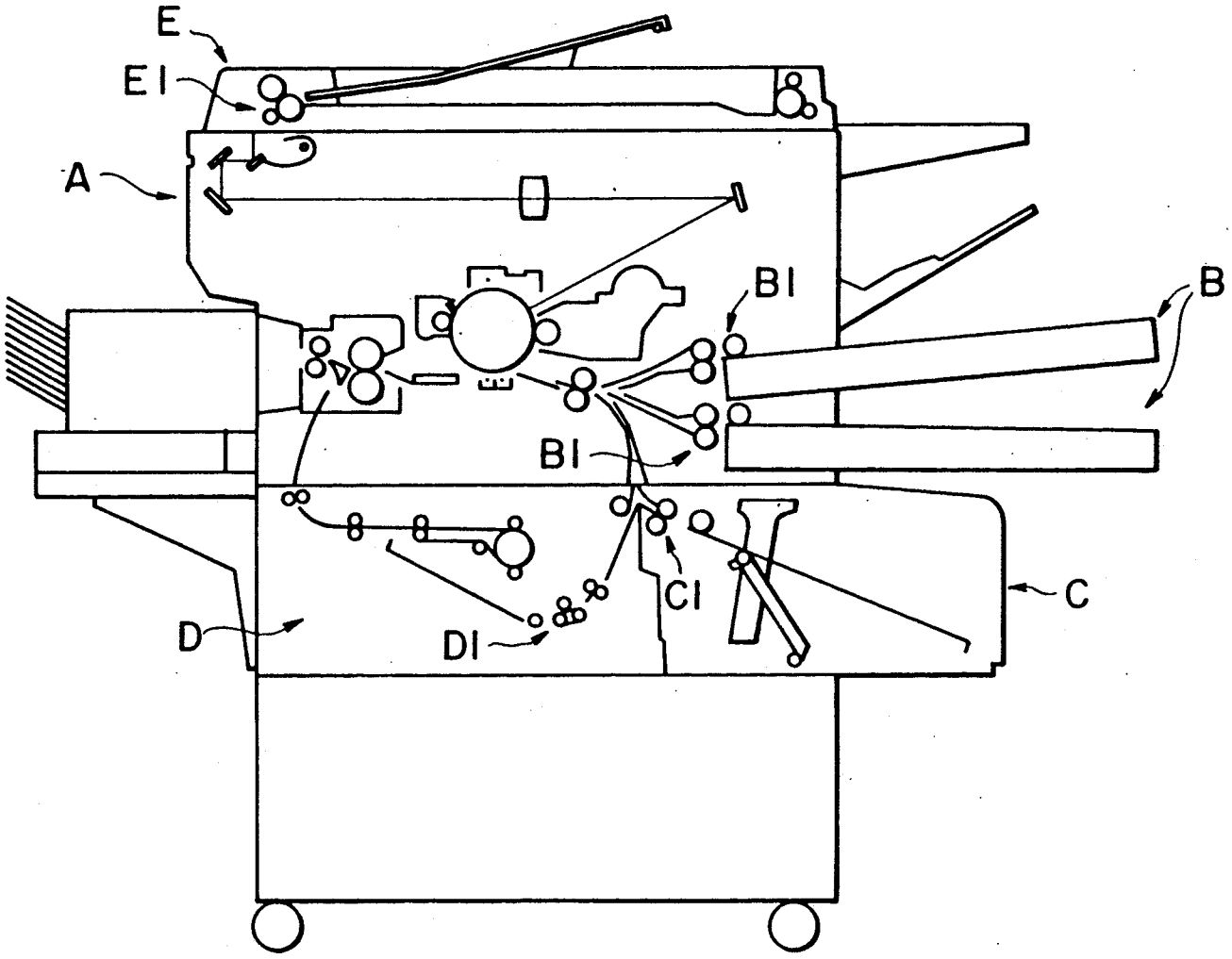
FIG. 5 is a schematic view showing each paper feeding unit of a copy machine according to one embodiment of the present invention.

As shown in FIG. 5, a sheet feeding apparatus of the present invention is applied to a sheet storage cassette B installed on the side of an image forming apparatus A wherein the cassette B can be mounted and dismounted quickly, a sheet feeding unit B1, a sheet feeding unit C1 of a large capacity sheet tray C which can hold as many as 1000 sheets of paper mounted below cassette B, a paper feeding unit D1 of an automatic double-sided document copying apparatus D installed at the bottom of the image forming apparatus A, and a paper feeding unit E1 of an automatic document feeding apparatus E installed above the image forming apparatus A. FIG. 1 is a perspective view showing a principal portion of a driving and conveying system of a sheet feeding apparatus. FIG. 2 is a perspective view of a separating roller of the paper feeding apparatus.

Figure 6:
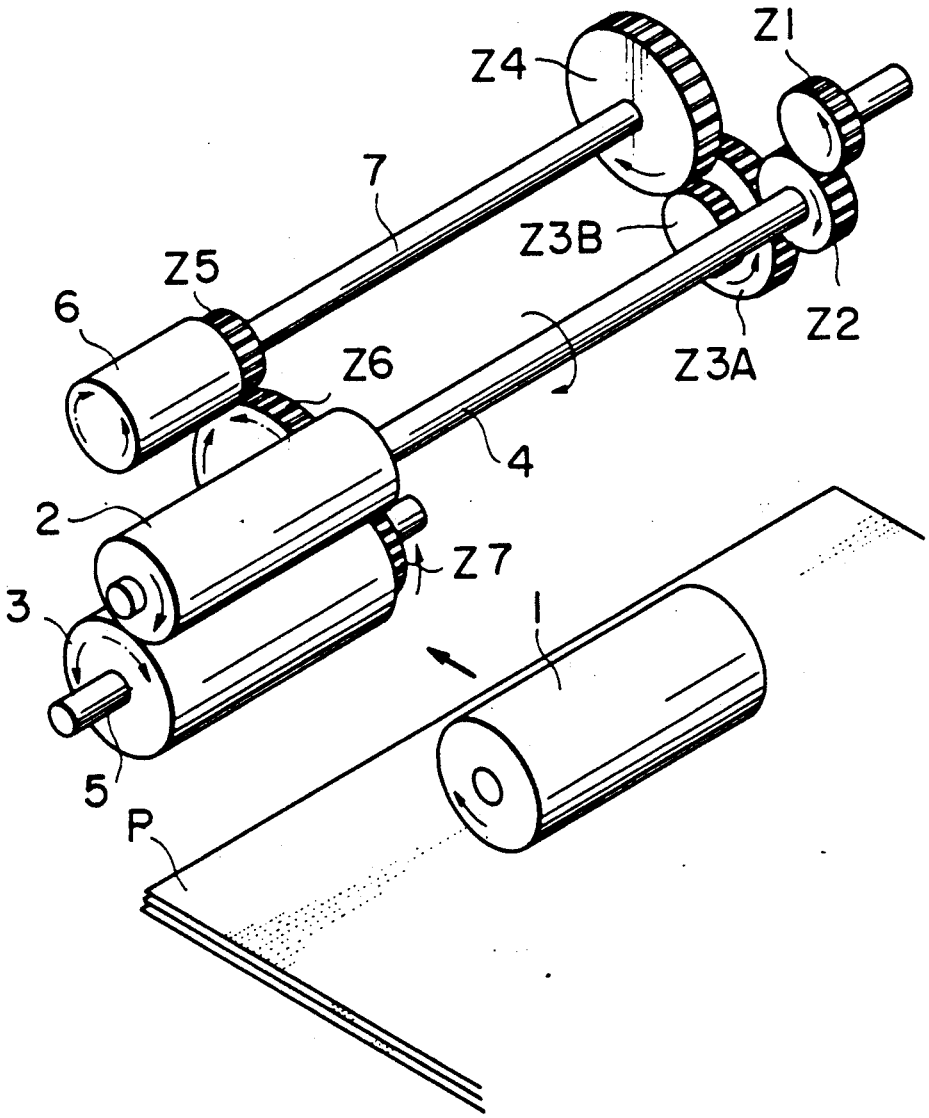
FIG. 6 PRIOR ART
FIG. 6 is a perspective view of a conventional paper feeding apparatus.

In FIGS. 1 and 2, the portions which have the same function as FIG. 6, are identified by the same signs as in FIG. 6.

A paper feeding apparatus of the invention consists of the delivery roller 1 which comes into contact with the surface of papers P with a prescribed pressure stacked on a paper tray or a paper feeding cassette, and the double feeding prevention mechanism installed ahead of the delivery roller 1.

The circumferential surface of the delivery roller 1 is coated with rubber. The roller is driven by a driving unit, which is not shown in the drawing, in the direction of the arrow and delivers a paper by the friction between the surface of the roller and the upper surface of the paper. When strong friction force exists between the first paper and the second one, the delivery roller 1 sends out not only the first paper, but also the second paper.

The double feeding preventing mechanism is composed of the feeding roller 2 which is supported by the drive shaft 4 and rotated in the direction of the arrow mark, and the separating roller 3 which is installed facing the feeding roller 2.

The circumferential surface of the feeding roller 2 is also coated with rubber and driven by a drive unit, which is not shown in the drawing, in the direction of the arrow mark synchronizing with the delivery roller 1 to pass a paper between the feeding roller 2 and the separating roller 3.

The separating roller 3 has the gear Z7 at the end of the shaft 5 parallel with its axial line, and it is installed in the frame 8 rotatably. In the frame 8, the spring 9 is installed to pull the separating roller 3 toward the feeding roller 2, so the distance between the shafts of the separating roller 3 and the feeding roller 2 is adjustable and the separating roller 3 always comes into contact with the feeding roller 2 with pressure by the spring.

The gear Z7 mounted in the separating roller 3 is engaged with the gear Z5 through the intermediate gear Z6. The torque limiter is installed at the torque limiter shaft 7 to which the gear Z5 is fixed. The fixed pin 10 is mounted on the torque limiter shaft 7.

The twisting coil spring 11 is wound around the circumference of one end of the torque limiter shaft 7. One end of the spring 11 is hooked around fixed pin 10, and the other end of the spring is fixed at to frame 8. When the torque limiter shaft 7 rotates normally in the direction of the solid line arrow mark, the spring is twisted and is charged with the resiliency of the spring. When the torque limiter 6 is allowed to rotate with the torque limiter shaft 7 in the direction of the dashed line with an arrow mark, the resiliency charged in the twisted coil spring 11 drives the torque limiter shaft 7, rotates the gear Z5, and rotates the separating roller 3 through the above-mentioned gear train in the direction of the dashed line arrow mark.

The sheet feeding process of this sheet feeding apparatus will be explained as follows. First of all, the delivery roller 1 and the feeding roller 2 rotate in the normal direction to feed the papers to a copying apparatus and the separating roller 3 which comes into contact with the feeding roller 3 with pressure also rotates in the same direction. Furthermore, the rotating power is transmitted to the torque limiter 6 through the gear train.

This transmitted power overwhelms the rotation resistance of the torque limiter 6 and rotates the torque limiter shaft 7 in the feeding direction. The fixed pin 10 mounted on the torque limiter shaft 7 twists the twisting coil spring 11 and the coil spring is tensioned to have resiliency.

Before the process explained above, the delivery roller 1 comes into contact with the prescribed pressure with the uppermost sheet of a pile of sheet papers which were lifted to the set point. The delivery roller 1 starts rotating and sends a paper P to the nip position between the feeding roller 2 and the separating roller 3. After that, the delivery roller 1 is released from the surface of the uppermost sheet.

The resiliency of the twisting coil spring 11 is transmitted to the separating roller 3 through the torque limiter 6 and the above-mentioned gear train, and the separating roller 3 is driven opposite to the feeding direction of paper P. The separating roller 3 comes into contact with the feeding roller 2 with pressure by the resiliency of the spring 9 and the twisting coil spring 11 which rotates the torque limiter shaft 7 using the frame 8 as a fulcrum.

When the separating roller 3 directly comes into contact with the feed roller 2, in other words there is no paper at the nip position, or a paper P is conveyed to the nip position, the separating roller 3 is rotated by the feeding roller 2 because the torque of the separating roller 3 exceeds the limitation torque set to the torque limiter 6 and the limiter slips on the shaft 7 in the direction of the solid line arrow mark in FIG. 1.

But in a case when more than 2 papers P are sent by the delivery roller 1 to the nip position, the resiliency of the twisted coil spring 11 and the torque limiter 6 overwhelm the friction between papers and the separating roller 3 is rotated reversely in the direction of the dashed line arrow mark in the drawing. As a result, the lower paper is pushed back toward the delivery roller 1 and double feeding is prevented.

When the loaded torque of the separating roller 3 is smaller than the resilient torque of the torque limiter 6 generated by the twisted coil spring 11, the separating roller 3 rotates to tension the spring 11.

In a case when torque higher than the friction resistance of the torque limiter 6 to the shaft 7 is applied to the separating roller 3, the torque limiter 6 slips on the shaft 7 and the separating roller 3 can rotate.

The conditions to send out a sheet paper by this sheet paper feeding apparatus are shown as follows, if weight of sheet paper P is neglected.

$$Ta > \mu p \times Pb \quad (1)$$

$$Ta < \mu r \times Pb \quad (2)$$

$$\frac{1}{\mu P} \times Ta > Pb > \frac{1}{\mu T} \times Ta$$

According to the inequality (1), when the resiliency Ta of the torque limiter 6 by the twisting coil spring 11 is larger than the conveyance force of the second paper which is determined by the torque Pb of the separating roller 3 and the friction coefficient $\mu p$, double feeding is prevented.

According to the inequality (2), when the conveyance force of the uppermost paper P which is determined by Pb and the friction coefficient $\mu r$ between the feeding roller 2 and the paper P, is larger than Ta, only the uppermost paper is sent out.

Even when a plurality of sheet papers are sent out from the delivery roller 1 together, they are positively separated from the uppermost sheet by the above-mentioned mechanism and only one sheet is surely fed to an image forming apparatus.

Figure 3:
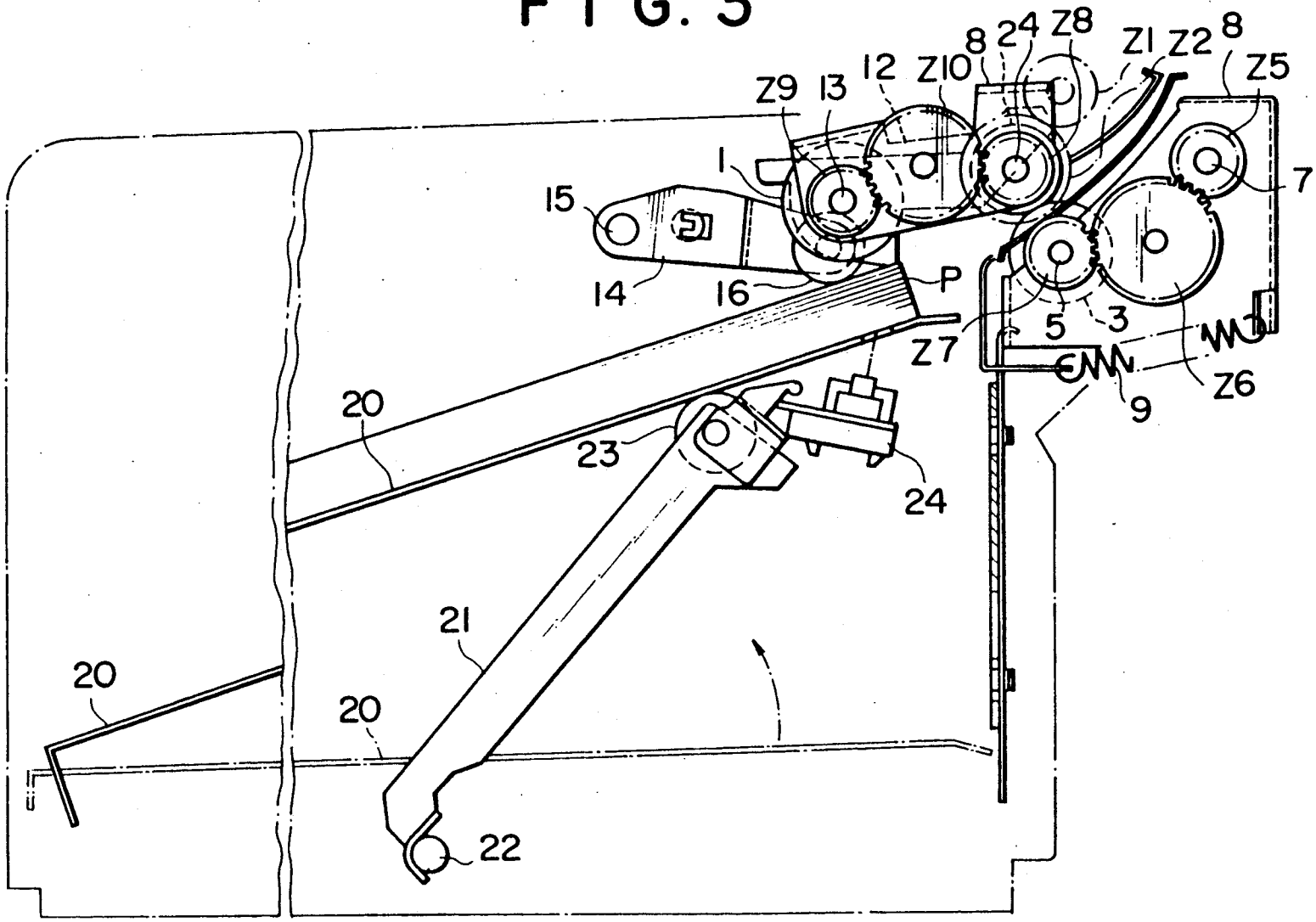
FIG. 3 is a sectional view of a large capacity paper tray.

FIG. 3 shows an embodiment in which a paper feeding apparatus of the present invention is applied to a large capacity sheet tray C (shown in FIG. 5).

As shown in FIG. 5, the large capacity paper tray C in this embodiment is mounted at the bottom of the image forming apparatus A and can be used together with the ordinary sheet storage cassette B. The large capacity sheet tray C can be mounted and dismounted quickly to to be changed to other paper feeding cassette.

Each member forming the drive unit is installed at the outside of the above-mentioned large capacity sheet tray C, which is called the sheet feeding unit C in this specification hereafter, and when the sheet feeding unit C is mounted in the image forming apparatus A, it is connected with the power system in the image forming apparatus A to be driven.

On the other hand, the conveyance system is installed in the sheet feeding unit C. According to the action of each member of the drive unit, the conveyance system conveys the uppermost recording sheet of the pile one by one to a recording sheet conveyance path in the image forming apparatus. In drawings, Z1 is a drive shaft which penetrates through a side base plate and is supported by a supporting plate fixed to a roof panel (not shown in the drawing), and Z2 is a gear which is fixed at the end of the drive shaft 4 and the gear Z2 is engaged with the above-mentioned gear Z1.

Z8 is a gear which is fixed to the drive shaft 4 at the outer side of the above-mentioned supporting plate (not shown in the drawing). The numeral 12 is a bracket-shaped rotatable plate which can rotate around the drive shaft 4. The numeral 13 is a rotating shaft which is rotatably installed at the tip of the rotatable plate 12. Z9 is a gear which is fixed to the protruded tip of the rotatable plate 12 installed at the rotation shaft 13. Z10 is an intermediate gear which is engaged with the gear Z9 and Z8. The numeral 2 is a feed roller which is installed at the drive shaft 4. The numeral 1 is a delivery roller which is installed at the rotating shaft 13.

The rotatable plate 12 is rotated around the drive shaft 4 by a cam block which is not shown in the drawing and moves the delivery roller 1 up and down.

The numeral 8 is a frame on which the torque limiter shaft 7 is installed in the relation to the feeding roller 2. Z5 is a gear which is fixed to the torque limiter shaft 7 at the outside of the frame 8. The torque limiter 6 and the twisting coil spring 11 are mounted on the torque limiter shaft 7.

Z6 is an intermediate gear which is engaged with the gear Z5. Z7 is a gear which is engaged with the intermediate gear Z6. The numeral 5 is a supporting shaft which is equipped with the gear Z7. The numeral 3 is a separating roller which is installed at the supporting shaft 5. The separating roller comes into contact with the feeding roller 2 with pressure by the action of the spring 9 which energizes the frame 8 clockwise. The separating roller 3 and the feeding roller 2 compose a pair of rollers which prevent double feeding.

The numeral 14 is a pair of pressing lever. The numeral 15 is a shaft at which the pressing lever is rotatably installed. The numeral 16 is a guide roller which is installed at the tip of the pressing lever. The pressing lever 14 forces the guide roller 16 with its own weight within the prescribed range of angle to come into contact with the front side corner of the uppermost paper P located at the prescribed height.

The numeral 20 is a tray in which papers P are stacked. The tray is rotated counterclockwise from the horizontal position drawn by dashed lines with regard to the folding point of the left side end. The numeral 21 is an rotating lever which is fixed to the rotation shaft 22 mounted between the front and rear side base plates and it is rotated by a power source which is not shown in the drawing.

The numeral 23 is a pushing up roller which is mounted rotatably at the tip of the rotating lever 21. The rotating lever 21 and the lever 21 is raised by the driver with the pushing up roller on its tip. As a result, the pushing up roller 23 moves the tray 20. Then the pushing up roller 23 holds the tray 20 at a certain angle, for instance, at the angle shown by solid lines in FIG. 3.

The numeral 24 is a sheet detecting unit to detect the sheet paper P in the tray 20 with reflecting light, and it is mounted on the lower side of the tray 20 with a bracket.

Figure 4:
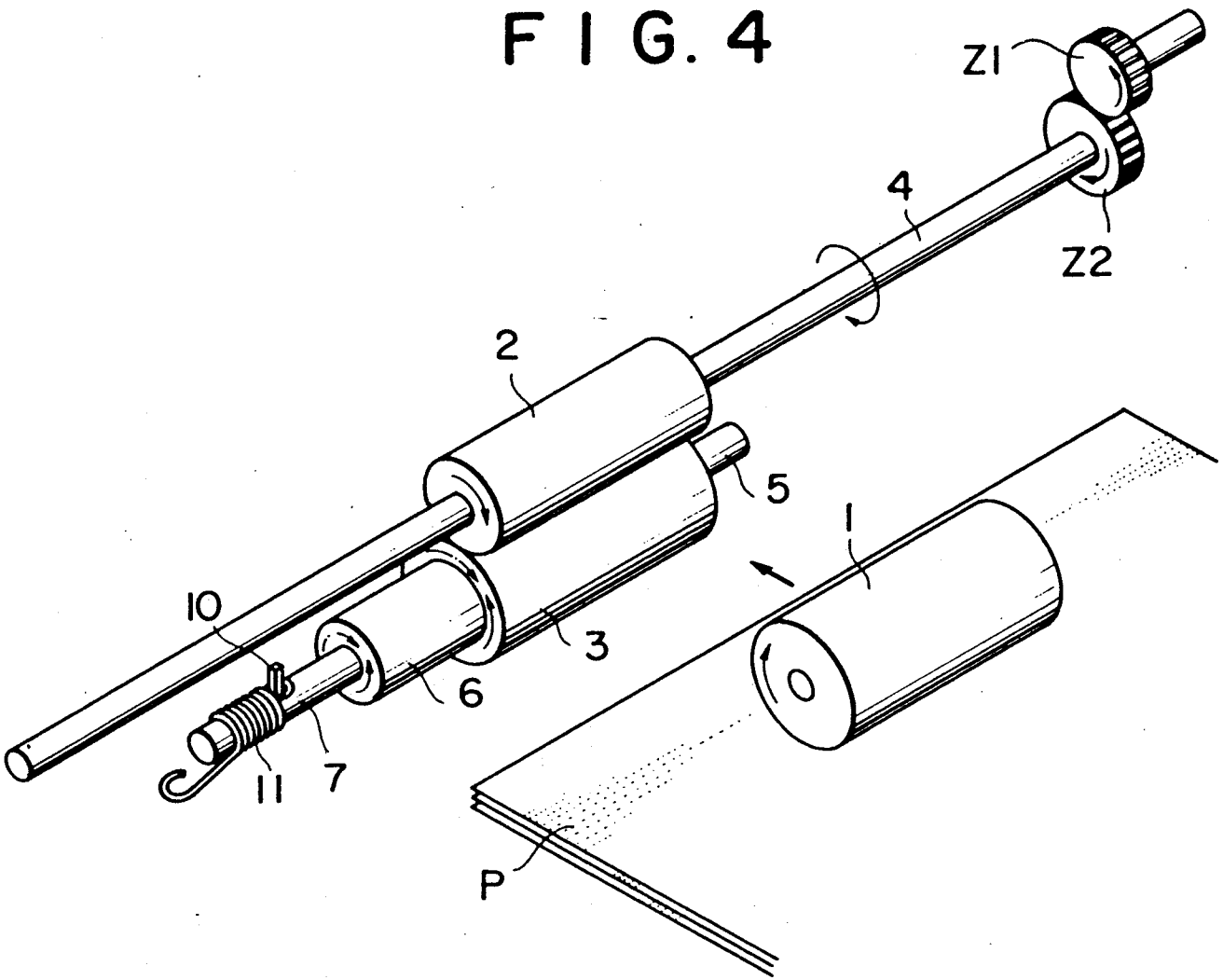
FIG. 4 is a perspective view showing a paper feeding apparatus according to another embodiment of the present invention.

FIG. 4 is a perspective view showing a sheet feeding apparatus according to another embodiment of the present invention. In FIG. 4, the portions with the same function as those of the above-mentioned embodiment are identified by the same signs. The different points from the above-mentioned embodiment will be explained as follows.

In this embodiment, the supporting shaft 5 of the separating roller 3 and the torque limiter shaft 7 use the same axis, and the torque limiter 6 and the coil spring 11 are mounted on the torque limiter shaft 7 in the same way as the above-mentioned embodiment.

This embodiment has features which will be described as follows.

In this embodiment, the gear train is omitted and both the separating roller 3 and torque limiter 6 are combined into one body, wherein the coil spring 11 is fixed to the torque limiter shaft 7 which is rotated through the torque limiter 6. This arrangement realizes the reduction of the number of parts and to make the apparatus compact.

The paper feeding process of this embodiment is almost the same as that of the above-mentioned embodiment. The separating roller 3 rotates in the direction of the solid line arrow mark in FIG. 4 and the coil spring 11 is tensioned by twisting it until the torque limiter begins to idle on the torque limiter shaft 7.

When sheets P are double fed, slip occurs between the sheets since the feeding roller 2 and the separating roller 3 rotate in opposing directions. The slip between the sheets decreases the driving torque of the feeding roller 2. As a result, the tension Of the twisted coil spring 11 is released and the separating roller 3 is rotated in the direction of the dashed line arrow mark in the drawing. In this way, only the uppermost sheet P which comes into contact with the feeding roller 2 passes through the nip position between the feeding roller 2 and the separating roller 3 by the feeding rotation of feeding roller 2 and separating roller 3. When other sheets are fed to the nip position together with the sheet P, they are pushed back by the separating roller 3 since the roller functions as explained above.

A paper feeding apparatus of the present invention is useful and applicable not only to various kinds of paper feeding units such as the one shown in FIG. 5, but also to the general type paper feeding apparatus for the use of facsimile and printers which comprises a friction separating roller.

Since a sheet feeding apparatus of the present invention has the structure explained above, the power transmitting system to drive the torque limiter such as a gear train is not necessary. So, motor load to cause reverse rotation of the separating roller 3, during double feeding prevention operation, can be reduced; furthermore, fluctuation of load to the separating roller 3 is so small that paper feeding is surely and smoothly conducted.

Power to drive separating roller 3 as it prevents double feed of sheets is accumulated by twisting the coil spring when the separating roller is rotated in the sheet feeding direction. Therefore, a long driving shaft is unnecessary and furthermore the structure is simple. Accordingly, a sheet feeding apparatus of the invention is quite effective in order to make the apparatus compact and reduce the production cost.

What is claimed is:

1. A sheet feed apparatus for individually feeding a plurality of sheets to a sheet receiver, said apparatus mounted on a frame and comprising:

a sheet storage for storing the sheets, a delivery roller for conveying the sheets in a feeding direction from the sheet storage to the sheet receiver, a feeding roller and a separation roller in contact with each other, whereby the separation roller cooperates with the feeding roller to feed the sheets in the feeding direction and also to separate one of the sheets from the others, whereby the sheets are fed to the sheet receiver singly, a rotation resistor connected to the separation roller and rotatable with respect to the frame, and a spring member urging the separation roller in an opposite direction to the feeding direction, wherein one end of the spring member is attached to the frame and the other end is attached to the rotation resistor, whereby a bias of the rotation resistor and the spring member is such that power to the separation roller in the feeding direction is enough to overcome the bias when only one sheet is between the feeding roller and the separation roller, thereby permitting the separation roller to rotate in the feeding direction and allow the sheet pass, and the power is not enough to overcome the bias when more than one sheet is between the feeding roller and the separation roller, whereby the separation roller rotates in the opposite direction to prevent more than one sheet from passing.

2. The apparatus claimed in claim 1 wherein the sheet receiver is a copying apparatus.

3. The apparatus claimed in claim 2 wherein the sheets are recording sheets.

4. The apparatus claimed in claim 1 wherein the rotation resistor is a torque limiter.

* * * * *